US006655935B2

(12) United States Patent
Bennitt et al.

(10) Patent No.: US 6,655,935 B2
(45) Date of Patent: Dec. 2, 2003

(54) GAS COMPRESSOR COMPRISING A DOUBLE ACTING PISTON, AN ELONGATE CHAMBER, MULTIPLE INLETS MOUNTED WITHIN HEADS ON BOTH SIDES OF THE CHAMBER, AND ONE CENTRAL OUTLET

(75) Inventors: Robert Bennitt, Painted Post, NY (US); Dale George, Corning, NY (US); Derek Woollatt, Campbell, NY (US); Tim Miller, Pine City, NY (US); Charles Seavey, Painted Post, NY (US); Steve Chaykosky, Athens, PA (US); Jim Crimmer, Corning, NY (US)

(73) Assignee: Dresser-Rand Company, Olean, NY (US)

( * ) Notice: Subject to any disclaimer, the term of this patent is extended or adjusted under 35 U.S.C. 154(b) by 0 days.

(21) Appl. No.: 10/047,385

(22) Filed: Jan. 14, 2002

(65) Prior Publication Data

US 2003/0133813 A1 Jul. 17, 2003

(51) Int. Cl.[7] ..... F04B 53/10

(52) U.S. Cl. ..... 417/534; 417/523; 417/526; 417/571; 417/569

(58) Field of Search ..... 417/53, 523, 534, 417/571, 525, 526, 422, 569

(56) References Cited

U.S. PATENT DOCUMENTS

| | | | | | |
|---|---|---|---|---|---|
| 1,479,603 | A | | 1/1924 | Hiller | |
| 1,568,776 | A | * | 1/1926 | Smith | 417/525 |
| 1,602,193 | A | * | 10/1926 | Garber | 417/525 |
| 2,295,592 | A | * | 9/1942 | McConnohie | 417/515 |
| 3,238,889 | A | * | 3/1966 | Huber et al. | 417/534 |
| 4,221,548 | A | * | 9/1980 | Child | 417/418 |
| 5,011,383 | A | * | 4/1991 | Bennitt | 417/534 |
| 5,015,158 | A | * | 5/1991 | Bennitt | 417/525 |
| 5,051,074 | A | * | 9/1991 | Cowan | 417/535 |
| 5,209,647 | A | * | 5/1993 | Bennitt | 417/261 |
| 5,236,008 | A | * | 8/1993 | Bennitt | 137/512 |
| 5,655,503 | A | * | 8/1997 | Kampichler et al. | 123/510 |
| 5,727,930 | A | * | 3/1998 | Bennitt et al. | 417/525 |
| 5,735,675 | A | | 4/1998 | Peoples et al. | |
| 5,958,134 | A | | 9/1999 | Yasar et al. | |
| 6,382,940 | B1 | * | 5/2002 | Blume | 417/571 |
| 6,464,474 | B2 | * | 10/2002 | Schluecker | 417/383 |

* cited by examiner

*Primary Examiner*—Charles G. Freay
*Assistant Examiner*—Emmanuel Sayoc
(74) *Attorney, Agent, or Firm*—Haynes and Boone, LLP.

(57) ABSTRACT

A gas compressor and method according to which a plurality of inlet valve assemblies are angularly spaced around a bore. A piston reciprocates in the bore to draw the fluid from the valve assemblies during movement of the piston unit in one direction and compress the fluid during movement of the piston unit in the other direction and the valve assemblies prevent fluid flow from the bore to the valve assemblies during the movement of the piston in the other direction. A discharge valve is associated with the piston to permit the discharge of the compressed fluid from the bore.

25 Claims, 6 Drawing Sheets

GAS COMPRESSOR COMPRISING A DOUBLE ACTING PISTON, AN ELONGATE CHAMBER, MULTIPLE INLETS MOUNTED WITHIN HEADS ON BOTH SIDES OF THE CHAMBER, AND ONE CENTRAL OUTLET

BACKGROUND

This invention relates, in general, to a fluid compressor, and, more particularly, to a compressor having an improved inlet valve arrangement.

Most current reciprocating compressor cylinders utilize a piston that reciprocates in a compressor cylinder formed in a frame with outer heads used to close off the ends of the cylinder. Inlet and discharge "check type" valves are provided for controlling the intake into, and the discharge from, the cylinder, and the reciprocating piston compresses the fluid internally within the compressor cylinder confines. The valves can be mounted tangentially to the bore of the cylinder or in the heads at a variety of angles to the axis of the piston.

However half the available area is usually allocated to the inlet valves and porting, and the other half to the discharge valves and porting. Thus, only a relatively low number of inlet valves can be used at each end of the compressor. This, of course, limits the inlet valve area and therefore the compression efficiency of the compressor.

BRIEF DESCRIPTION OF THE DRAWINGS

FIGS. 5*a*–5*h* are diagrammatic views depicting the operation of the compressor of FIG. 3.

BRIEF DESCRIPTION

Figure 1:
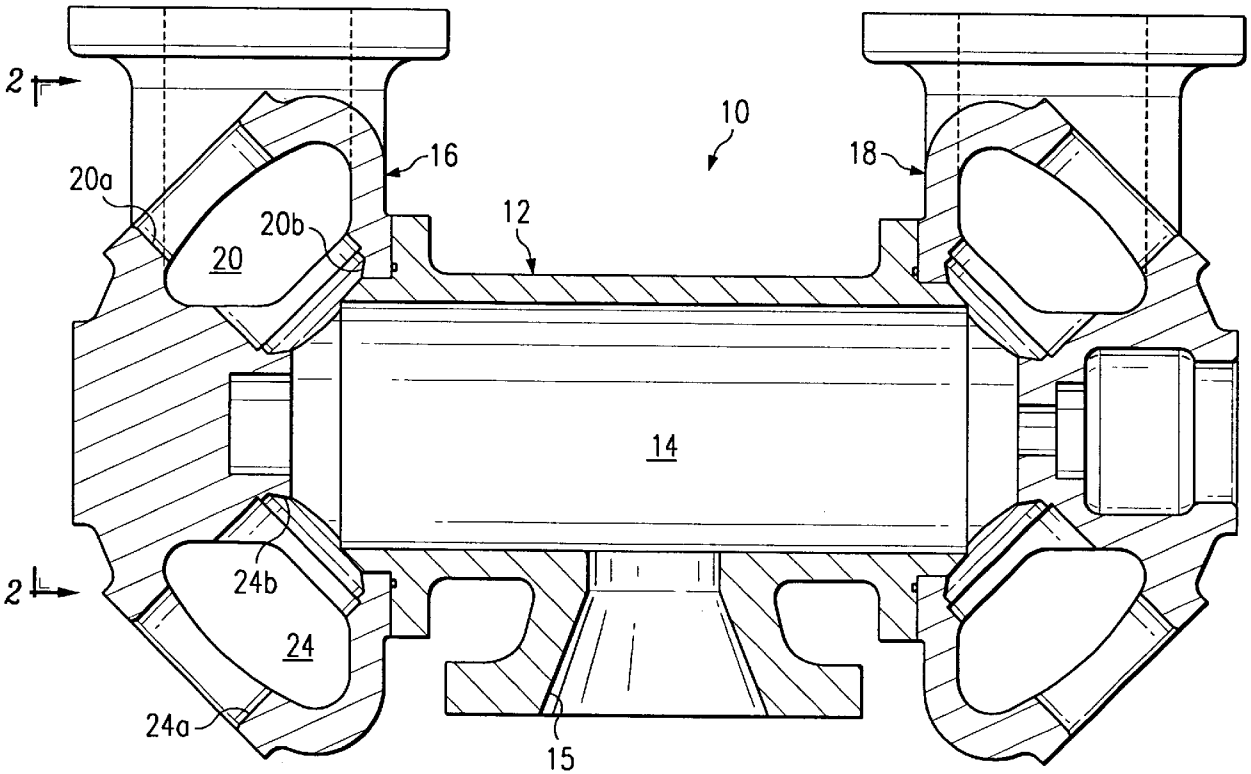
FIG. 1 is a sectional view of the housing and heads of a fluid compressor according to an embodiment of the present invention.

Referring to FIG. 1 of the drawings the reference numeral 10 refers, in general, to a compressor for compressing a fluid, such as gas, according to an embodiment of the present invention with some of its components being omitted in the interest of clarity. The compressor 10 includes a cylindrical housing 12 defining an internal cylindrical bore 14 and an outlet 15 registering with the bore. An outer head 16 is formed at one end of the housing 12, and a frame head 18 is mounted at the other end of the housing. The heads 16 and 18 are connected to the housing 12 in a conventional manner, and are configured to receive other components and permit fluid flow through the heads in a manner to be described.

Figure 2:
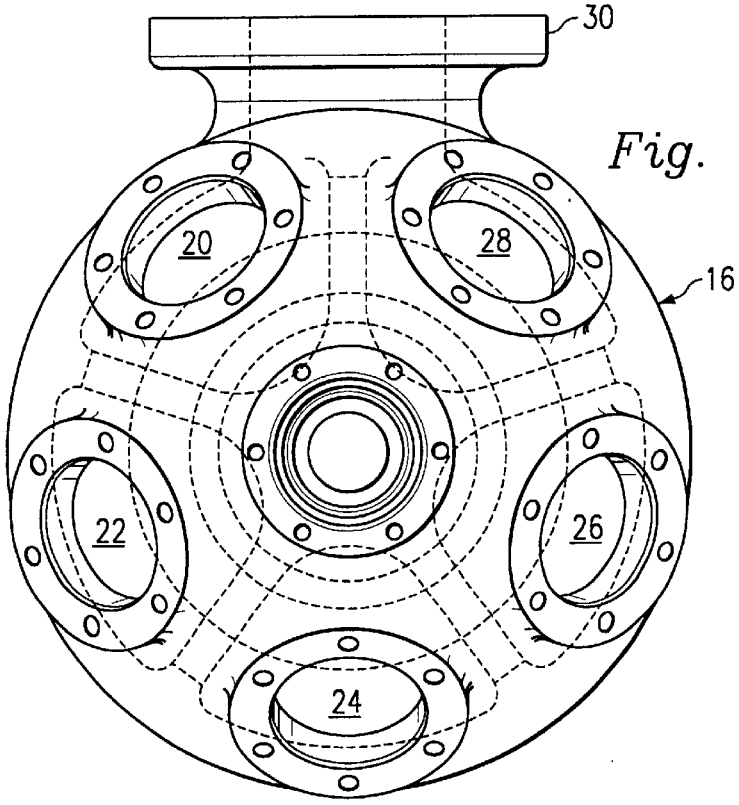
FIG. 2 is a side elevational view taken along the line 2—2 of FIG. 1.

As shown in FIG. 2, five angularly-spaced inlet chambers 20, 22, 24, 26, and 28 are formed in the head 16. The chambers 20, 22, 24, 26 and 28 are interconnected in the interior of the head 16 to permit fluid flow from chamber-to-chamber as will be described. The axis of each chamber

20, 22, 24, 26, and 28 extends at an angle to the longitudinal axis of the bore 14 as shown in connection with the chambers 20 and 24 in FIG. 1. As a non-limitative example, the latter angle is approximately 45 degrees.

As also shown in FIG. 1, the chamber 20 extends between two openings 20*a* and 20*b*, with the opening 24*b* being in communication with the chamber. Similarly, chamber 24 extends between two openings 24*a* and 24*b* in communication with the chamber 24. It is understood that the chambers 22, 26 and 28 (FIG. 2) are configured in a similar manner.

Figure 3:
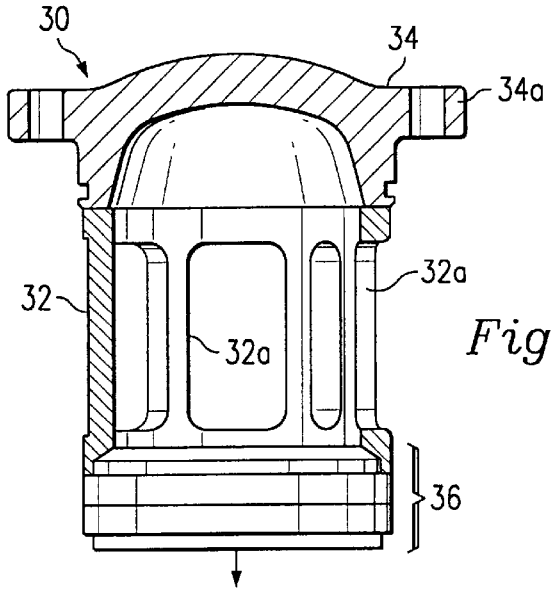
FIG. 3 is an elevational view of an inlet valve assembly utilized in the compressor of FIG. 1.

Referring to FIG. 3, a valve assembly 30 includes a cylindrical cage 32 extending between a cylindrical cover 34 and a valve unit 36 and connected thereto in any conventional manner. The cage 32 has a plurality of openings 32*a* formed through its side wall, and a flange 34*a* is provided on the cover 34 for engaging the outer surface of the head.

The valve unit 36 is conventional and can be in the form of a plate type valve, a poppet valve, a channel ring, or the like. As a non-limitative example, the valve unit 36 can be formed by a plurality of stacked plates as fully disclosed in U.S. Pat. Nos. 4,532,959 and 5,001,383 both of which are assigned to the assignee of the present invention. As well-disclosed in these patents, the valve unit 36 functions to permit the flow of gas through the unit in a direction indicated by the solid arrow in FIG. 3 in response to a predetermined fluid pressure in the chamber 20, but prevents flow in an opposite direction. The disclosure of each of the above-identified patents is hereby incorporated by reference.

Figure 4:
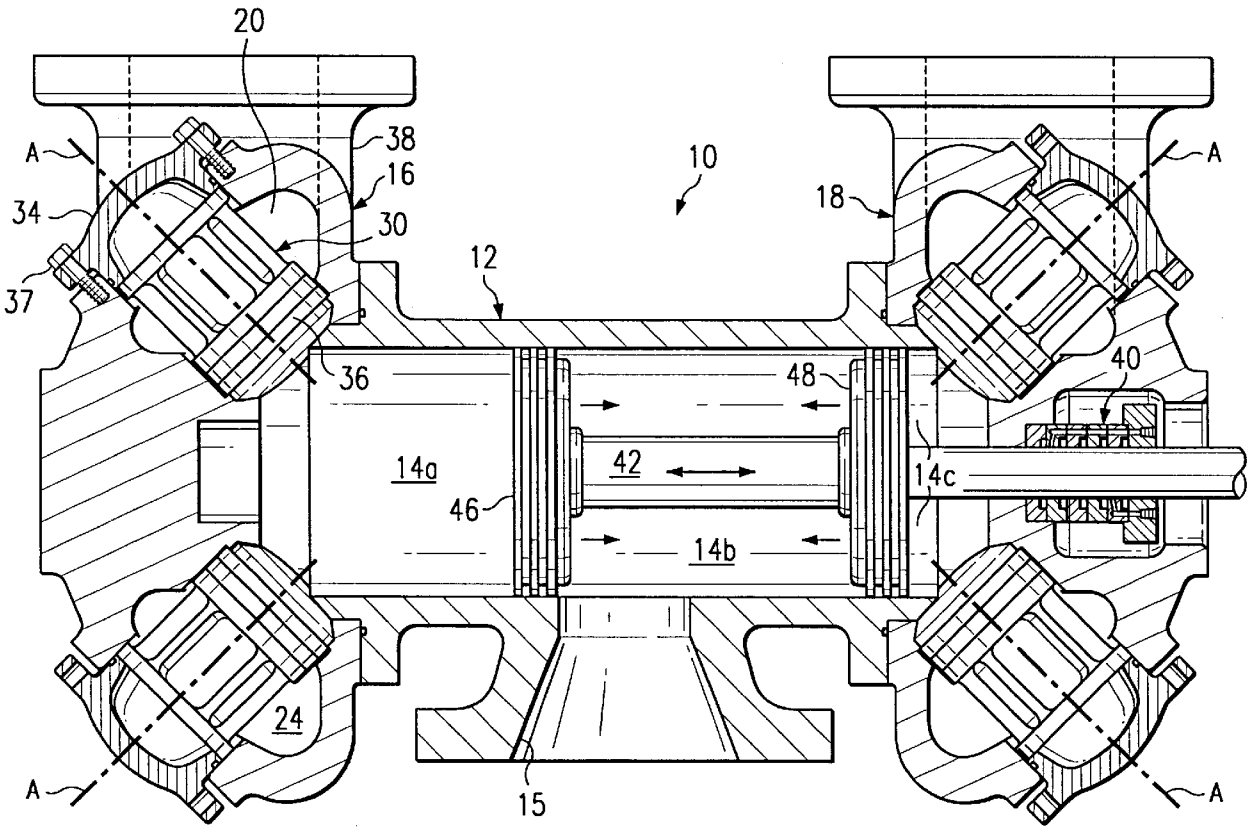
FIG. 4 is a view similar to FIG. 1, but depicting inlet valve assemblies installed in the heads of FIG. 1.

As shown in FIG. 4, the valve assembly 30 is mounted in the head 16 with the cover 34 extending in the opening 20*a* (identified in FIG. 1) of the chamber 20 and with its flange extending over the outer surface of the head. A plurality of bolts 37 (two of which are shown) extend through corresponding openings in the flange 34*a* which align with openings formed in the head 16 (FIG. 2) and surrounding the chamber 20. The cage 32 extends within the chamber 20, and the valve unit 36 extends in the opening 20*b* in communication with the bore 14.

A flanged inlet conduit 38 is formed integrally with the valve head 16 and is adapted to receive a fluid, such as gas, from an external source. The conduit 38 extends to an inlet passage (not shown) in the interior of the head, which inlet passage is connected to other passages formed in the interior of the head 16 that, in turn, extend to the interconnected inlet chambers 20, 22, 24, 26, and 28, so that the gas is distributed to all of the chambers. Valve assemblies identical to the valve assembly 30 are mounted in the chambers 22, 24, 26, and 28 in a similar manner, with the valve assembly in the chamber 14 also being shown in FIG. 4. Thus, the axis A of each valve assembly, including the valve assembly 30, extend at an angle to the axis of the bore 14, which, as stated above for the purpose of example, is approximately forty-five degrees.

Thus, when the gas is introduced into the head 16 via the inlet conduit 38 the gas is distributed to all of the chambers 20, 22, 24, 26, and 28 and discharges simultaneously through the respective valve assemblies, including the valve assembly 30, associated with the chambers 22, 24, 26, and 28 under conditions to be described.

Since the head 18 is similar to the head 16 and as such, contains five chambers identical to the chambers 20, 22, 24, 26, and 28, and five valve assemblies identical to the assembly 30, this structure will not be described in detail. Thus, when gas is introduced into the head 18, it is distributed to the valve assemblies for discharge into the bore 14 in the same manner as discussed above.

A packing gland assembly 40 is mounted in a chamber formed in the interior of the housing 12 in a conventional manner and seals compressed gas from leaking past a drive rod 42 which is mounted for reciprocal movement in the bore 14. An end portion of the rod 42 projects from the bore and, although not shown in the drawings, it is understood that the latter end portion is connected to a conventional prime mover for reciprocating the rod in a right-to-left and in a left-to-right direction as viewed in FIG. 4 and as shown by the double-headed arrow.

A piston/valve unit 46 is mounted to the other end of the rod 42, and another piston/valve unit 48 is mounted to the rod 42 in a spaced relation to the unit 46. The piston/valve units 46 and 48 can be of any conventional design and function in a manner to be described to both compress the gas in the bore 14 and selectively permit the flow of the gas through the units in a manner to be described. As a non-limitative example, each unit 46 and 48 is formed by a plurality of stacked plates as fully disclosed in the above-mentioned U.S. Pat. Nos. 4,532,959 and 5,001,383. As well disclosed in these patents, the units 46 and 48 function as pistons to compress the gas in certain sections of the bore 14 under conditions to be described, as well as permit the flow of gas through the units in a direction indicated by the arrows in FIG. 4 in response to a predetermined gas pressure in certain sections of the bore, but prevent flow in an opposite direction, also in a manner to be described.

The units 46 and 48, as well as the corresponding interior walls of the cylinder 12, divide the bore 14 into three sections 14*a*, 14*b*, and 14*c*. In particular, the unit 46 and the corresponding interior walls of the cylinder 12, including an end wall, define the bore section 14*a*. Similarly, the units 46 and 48, as well as the corresponding interior wall of the housing 12, define a bore section 14*b*; and the unit 48 and the corresponding interior walls of the cylinder 12, define a bore section 14*c*. The significance of these bore sections 14*a*, 14*b*, and 14*c* will be apparent from a description of the operation of the compressor 10 which is described with reference to FIGS. 5*a*–5*h*.

Figures 5A, 5B, 5C, 5D:
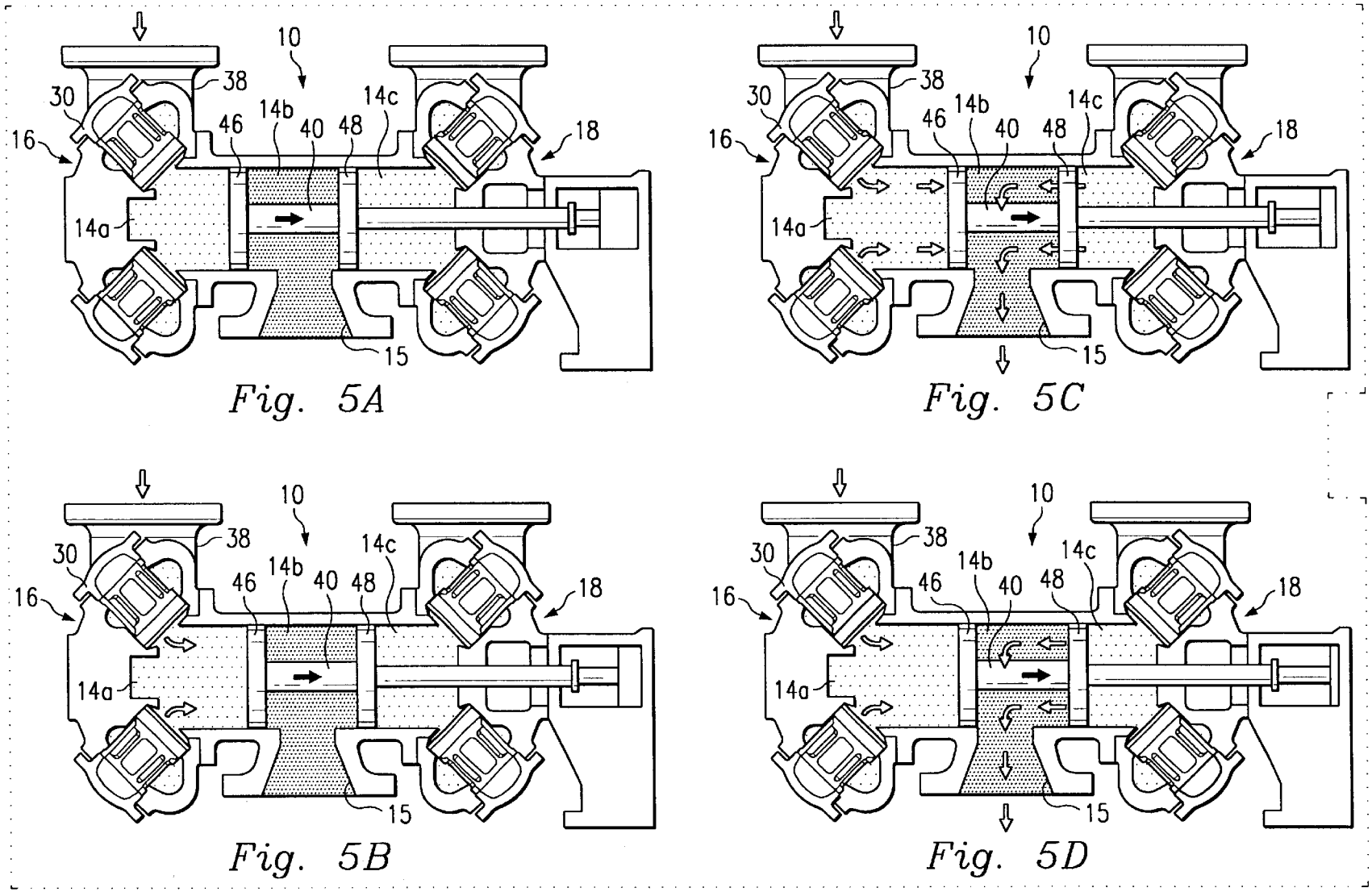

Referring to FIG. 5*a*, a fluid, such as gas, or other product, is introduced into the chambers 20, 22, 24, 26, and 28 (FIGS. 1 and 2) via the inlet conduit 38 and enters the interior of the cage 32 of the valve assembly 30 and the interior of the cages of the other four valve assemblies associated with the chamber 22, 24, 26, and 28. It will be assumed that gas is also in the bore section 14*c* and that the rod 42, and therefore the units 46 and 48, are in their extreme left position, as viewed in the FIG. 5*a* as a result of a previous cycle of the operation.

The rod 42, and therefore the units 46 and 48 are moved in a left-to-right direction from the position of FIG. 5*a* to the position of FIG. 5*b*, as shown by the solid arrow, under the power of the above-mentioned prime mover. This movement draws gas from the chamber 20, though the valve unit 36 of the valve assembly 30 as described above, and into the bore section 14*a*; while gas is drawn from the other four chambers 22, 24, 26, and 28 through their respective units, and into the bore section 14*a*, as shown by the hollow arrows. This movement also causes the gas in the bore section 14*c* to be compressed.

Further left-to-right movement of the rod 42, and therefore the units 46 and 48, to the position of FIG. 5*c* causes additional gas to be drawn in the bore section 14*a* in the manner discussed above, and further increases the fluid pressure in the bore section 14*c*. This movement continues until the pressure in the bore section 14*c* is great enough to cause movement of the compressed gas in the bore section 14*c* through the unit 48 in a general right-to-left direction and into the bore section 14*b*, as shown by the hollow arrows in FIG. 5*c*. The compressed gas in the bore section 14*b* exits the body member 12 through the outlet 15 and is transferred from the compressor 10 via a pipe, or the like, connected to the outlet. In the meantime, gas continues to be drawn into the bore section 14. This movement of the rod 42, and therefore the units 46 and 48, continues until they reach their end position shown in FIG. 5*d*.

Figures 5C, 5E, 5F, 5H:
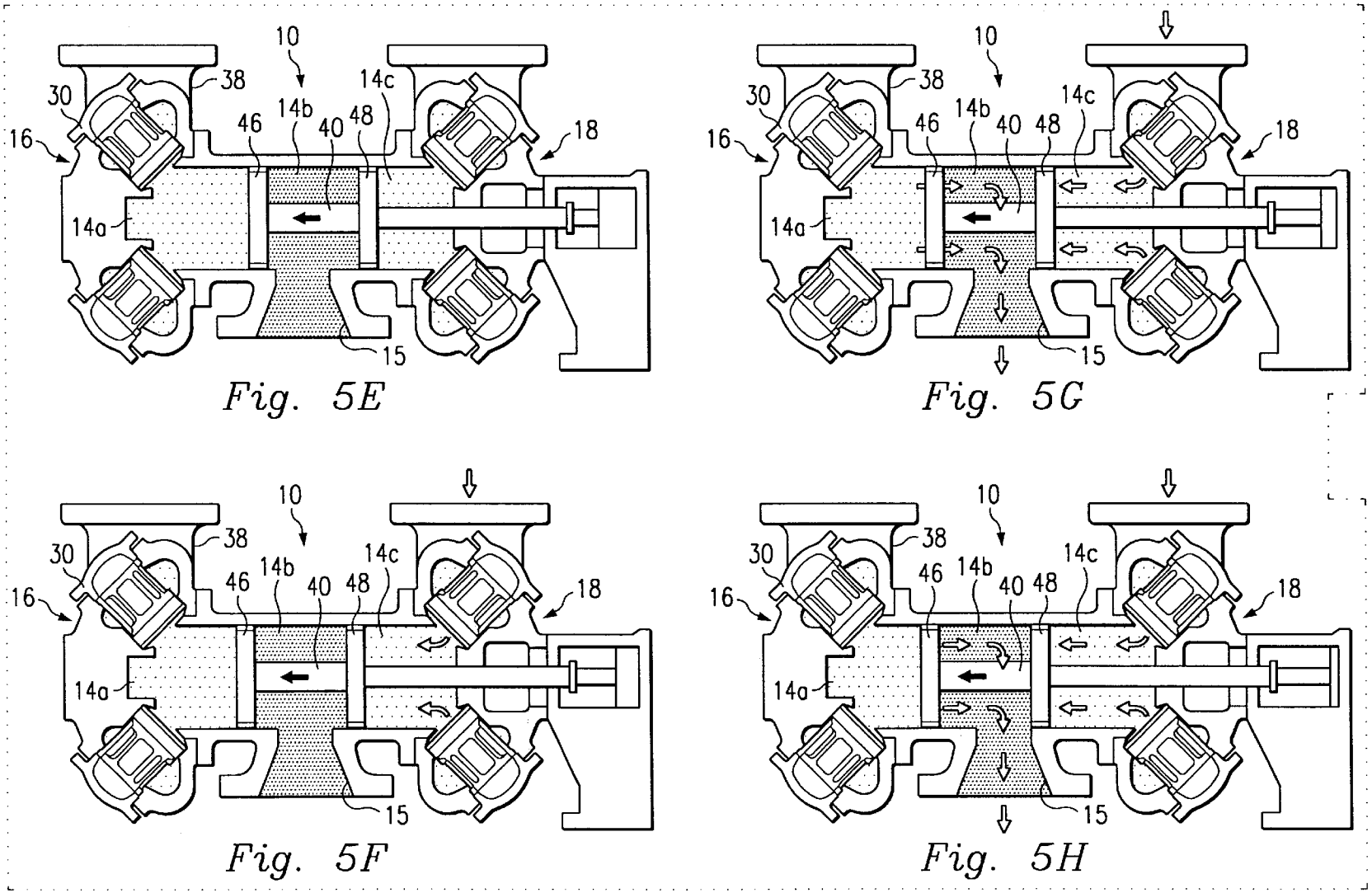

Referring to FIG. 5*e*, gas is also introduced into the above-mentioned chambers in the head 18 via the inlet conduit associated with the latter head, and enters the interiors of the valve assemblies respectively associated with the chambers, in the same manner as discussed above in connection with the valve head 16.

The rod 42, and therefore the units 46 and 48, are moved in a right-to-left direction from the position of FIG. 5*e* to the position of FIG. 5*f*, as shown by the solid arrow, under the power of the above-mentioned prime mover. This movement draws gas from the chambers associated with the head 18, and through their respective valve assemblies, and into the bore section 14*c*, as shown by the hollow arrows. This movement also causes the gas in the bore section 14*a* to be compressed.

Further right-to-left movement of the rod 42, and therefore the units 46 and 48, to the position of FIG. 5*g* causes additional gas to be drawn into the bore section 14*c* in the manner discussed above, and further increases the fluid pressure in the bore section 14*a*. This movement continues until the pressure in the bore section 14*a* is great enough to cause movement of the compressed gas in the latter bore section, through the unit 46 in a general left-to-right direction and into the bore section 14*b*, as shown by the hollow arrows in FIG. 5*g*. The compressed gas in the bore section 14*b* exits the bore 14 and the body member through the outlet 15 and is transferred from the compressor 10 via the above-mentioned pipe. In the meantime, gas continues to be drawn into the bore section 14*c*. This movement of the rod 42, and therefore the units 46 and 48, continues until they reach their other end position of FIG. 5*h*, and the cycle is then repeated.

It can be appreciated that the use of a plurality of inlet valves circumferentially spaced around the bore and the discharge valves in the bore area, significantly increases the available flow area for the gas being processed to enter the bore sections 14*a* and 14*c* thereby improving the compression efficiency.

Alternatives and Equivalents

Figure 6:
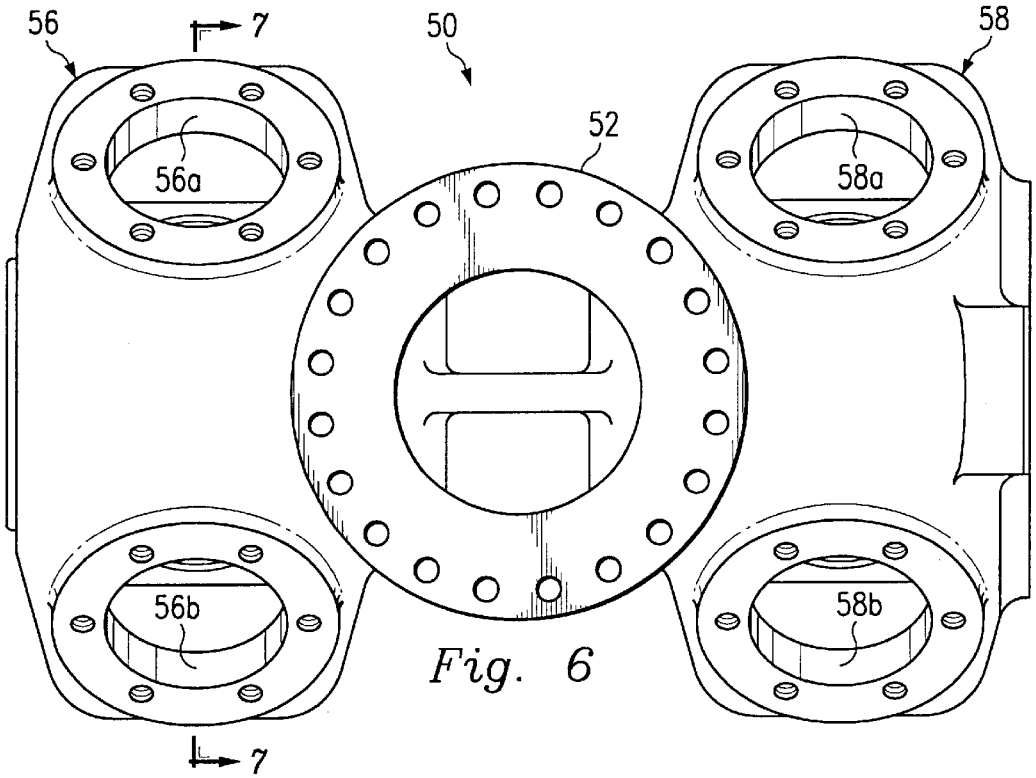
FIG. 6 is a plan view of an alternate embodiment of the present invention.
Figure 7:
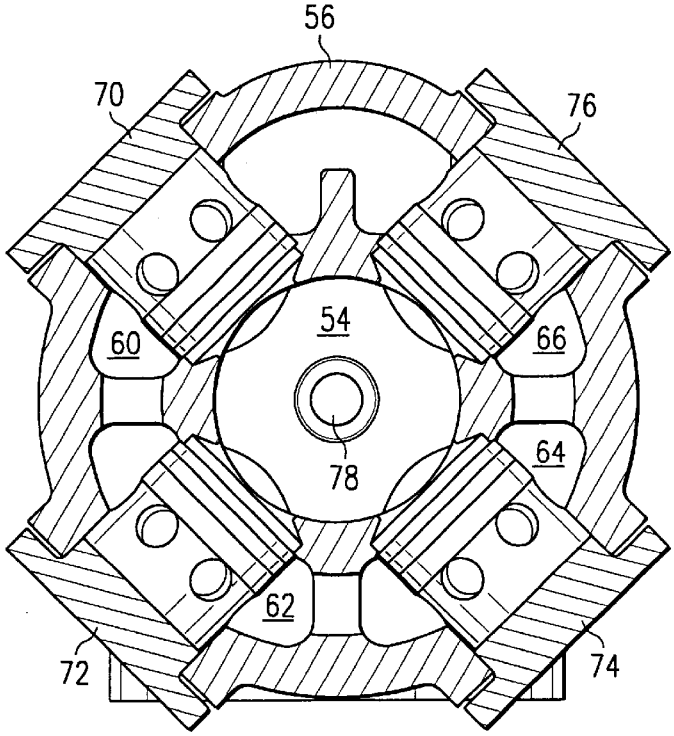
FIG. 7 is a cross-sectional view taken along the line 7—7 of FIG. 6.

An alternative embodiment of the compressor is shown, in general, by the reference numeral 50 in FIGS. 6 and 7. The compressor 50 includes a housing 52 defining an internal cylindrical bore 54 (FIG. 7) and an outlet (not shown) registering with the bore. An outer head 56 (FIG. 6) is formed at one end of the housing 52 and a frame head 58 is mounted at the other end of the housing. The heads 56 and 58 are connected to the housing 52 in a conventional manner, and are configured to receive other components and permit gas flow through the heads in a manner to be described.

As shown in FIG. 7, four angularly-spaced, interconnected, inlet chambers 60, 62, 64, and 66 are formed in the head 56 and are interconnected in the interior of the head 16 to permit gas flow from chamber to chamber as will be described. Four valve assemblies 70, 72, 74, and 76 are disposed in the chambers 60, 62, 64, and 66, respectively. The axes of the chambers 60, 62, 64, and 66, and therefore, the axes of the valve assemblies 70, 72, 74, and 76, extend perpendicularly to the bore. The valve assemblies 70, 72, 74, and 76 will not be described in detail since they are similar to the valve assembly 30 of the previous embodiment with the exception that the axial length of their respective cages, and therefore the sizes of the openings in the cages, are smaller when compared to the valve assembly 30.

Referring to FIG. 6, the outer surface of the head 56 is provided with four angularly-spaced openings, two of which are shown by the reference numerals 56*a* and 56*b*, which are connected to an inlet manifold, or conduit (not shown), for distributing gas, or other product to the chambers 54, 56, 58 and 60. The gas thus passes into each valve assembly 70, 72, 74, and 76 through the above-mentioned openings in their respective cages and thus discharges through the units of the assemblies into the bore 54 under the proper pressure conditions as in the previous embodiment.

Similarly, the outer surface of the head 58 is provided with four angularly-spaced, openings, two of which are shown by the reference numerals 58*a* and 58*b* which are also connected to an inlet manifold, or conduit, for distributing gas, or other product to the chambers associated with the head 58. Since the head 58 is identical to the head 56, it will not be described in detail. The gas thus passes through the above-mentioned openings in the respective cages of the valve assemblies (not shown) associated with the head 58, and is discharged into the bore 54 in a similar manner as discussed above.

Although not shown in FIGS. 6 and 7, it is understood that a packing gland assembly is mounted in a chamber formed in the interior of the housing 12 in a conventional manner and supports a drive rod 78 (FIG. 7) which is mounted for reciprocal movement in the bore 54. An end portion of the rod 78 projects from the bore 54 and, although not shown in the drawings, it is understood that the latter end portion is connected to a conventional prime mover for reciprocating the rod in a right-to-left and in a left-to right direction as viewed in FIG. 6. Two units (not shown) are mounted to the rod 78 in a spaced relation. Since the rod 78 and the units are identical to, and function in the same manner as, the rod 42 and the units 46 and 48, they will not be described in further detail.

The operation of the compressor 50 is the same as that of the previous embodiment with the exception that the gas is introduced into the bore 54 in a radial direction via the four valve assemblies 70, 72, 74, and 76. Thus, the operation of the compressor 50 is identical to that described in FIGS. 5*a*–5*h* in connection with the previous embodiment.

The embodiment of FIGS. 6 and 7 thus enjoys all of the advantages of the previous embodiment with respect to horsepower output and efficiency.

It is understood that other alternates and equivalents of each of the above embodiments are within the scope of the invention. For example, the number of inlet chamber and valve assemblies in each of the above embodiments can vary. Also, the valve assembly 30 in the embodiment of FIGS. 1–5 does not have to have a cage 32.

Those skilled in the art will readily appreciate that many other modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures.

What is claimed is:

1. A fluid compressor comprising a housing defining an internal bore and an outlet registering with the bore; two spaced heads disposed at the respective ends of the bore and adapted to receive the fluid; a first series of inlet valve assemblies disposed in one of the heads and radially spaced from the central axis of the bore for permitting the flow of the fluid from the one head and into the bore and for preventing the flow of the fluid from the bore to the one head; a second series of inlet valve assemblies disposed in the other head and angularly spaced around the central axis of the bore for permitting the flow of the fluid from the other head, and into the bore and for preventing the flow of the fluid from the bore to the other head; and two spaced piston/valve units mounted in the bore for reciprocal movement and adapted to move in one direction to draw the fluid through one series of valve assemblies and into the bore while compressing the fluid in the bore from the other series of valve assemblies, and to move in the opposite direction to draw the fluid through the other series of valve assemblies and into the bore while compressing the fluid in the bore from the one series of valve assemblies.

2. The compressor of claim 1 wherein the fluid passes from the one head, through the first series of valve assemblies, and into the bore; and from the other head, through the second series of valve assemblies, and into the bore.

3. The compressor of claim 2 wherein each inlet valve assembly normally prevents fluid flow and responds to a predetermined fluid pressure acting on it to permit the fluid to pass though it.

4. The compressor of claim 1 wherein, during movement of the piston/valve units in the one direction, the second series of valve assemblies prevents the flow of fluid from the bore to the other head, and during movement of the piston/valve units in the other direction, the first series of valve assemblies prevents the flow of fluid from the bore to the one head.

5. The compressor of claim 1 wherein the axis of each valve assembly extends at an angle to the central axis of the bore.

6. The compressor of claim 1 wherein a plurality of angularly-spaced inlet chambers are formed in each head and are adapted to receive the fluid, and wherein the first and second inlet valve assemblies are mounted in the inlet chambers of the two heads, respectively.

7. The compressor of claim 6 wherein the chambers are interconnected in the interior of the head to permit the fluid to flow between the chambers.

8. The compressor of claim 6 wherein the chambers are radially spaced around the central axis of the bore.

9. The compressor of claim 1 wherein the compressed fluid flows through the respective piston/valve units before passing to the outlet.

10. The compressor of claim 1 further comprising a rod mounted for reciprocal movement in the bore and wherein the piston/valve units are attached to the rod.

11. The compressor of claim 1 wherein there are at least three valve assemblies disposed in each head and equiangularly spaced around the bore.

12. The compressor of claim 1 wherein there are five valve assemblies disposed in each head and equiangularly spaced around the bore.

13. A fluid compressor comprising a housing defining an internal bore and an outlet registering with the bore; two spaced heads disposed at the respective ends of the bore and adapted to receive the fluid; a first series of inlet valve assemblies disposed in one of the heads and radially spaced from the central axis of the bore for permitting the flow of the fluid from the one head and into the bore and for preventing the flow of the fluid from the bore to the one head; a second of inlet valve assemblies disposed in the other head and radially spaced from the central axis of the bore for permitting the flow of the fluid from the other head, and into the bore and for preventing the flow of the fluid from the bore to the other head; and means mounted in the bore for reciprocal movement and adapted to move in one direction to draw the fluid through one series of valve assemblies and into the bore while compressing the fluid in the bore from the other series of valve assemblies, and to move in the opposite direction to draw the fluid through the other series of valve assemblies and into the bore while compressing the fluid in the bore from the one series of valve assemblies.

14. The compressor of claim 13 wherein the fluid passes from the one head, through the first series of valve assemblies, and into the bore; and from the other head, through the second series of valve assemblies, and into the bore.

15. The compressor of claim 14 wherein each valve assembly normally prevents fluid flow and responds to a predetermined fluid pressure acting on it to permit the fluid to pass though it.

16. The compressor of claim 13 wherein, during movement of the means in the one direction, the second series of valve assemblies prevents the flow of fluid from the bore to the other head, and during movement of the means in the other direction, the first series of valve assemblies prevents the flow of fluid from the bore to the one head.

17. The compressor of claim 13 wherein the axis of each valve assembly extends radially from to the central axis of the bore.

18. The compressor of claim 13 wherein a plurality of angularly-spaced inlet chambers are formed in each head and are adapted to receive the fluid, and wherein the first and second inlet valve assemblies are mounted in the inlet chambers of the two heads, respectively.

19. The compressor of claim 18 wherein the chambers are interconnected in the interior of the head to permit the fluid to flow between the chambers.

20. The compressor of claim 18 wherein the chambers are radially spaced around the central axis of the bore.

21. The compressor of claim 13 wherein the compressed fluid flows through the means before passing to the outlet.

22. The compressor of claim 13 further comprising a rod mounted for reciprocal movement in the bore and wherein the means is attached to the rod.

23. The compressor of claim 13 wherein there are at least three valve assemblies disposed in each head and equiangularly spaced around the bore.

24. The compressor of claim 13 wherein there are five valve assemblies disposed in each head and equiangularly spaced around the bore.

25. The compressor of claim 13 wherein the means comprises two spaced piston/valve units.

* * * * *